US005547284A

United States Patent [19]

Imer

[11] Patent Number: 5,547,284

[45] Date of Patent: Aug. 20, 1996

[54] BAG FOR LIQUIDS, PASTES, OR GRANULATES AND METHOD OF MANUFACTURING

[76] Inventor: Rodney H. Imer, Berliner Allee 45, 40272 Düsseldorf, Germany

[21] Appl. No.: 430,092

[22] Filed: Apr. 26, 1995

Related U.S. Application Data

[63] Continuation of Ser. No. 70,612, Jun. 1, 1993, abandoned.

[30] Foreign Application Priority Data

Jun. 4, 1992 [DE] Germany ..... 92 07 558.4

[51] Int. Cl.[6] ..... B65D 30/16

[52] U.S. Cl. ..... 383/104; 383/105; 383/120; 383/121; 383/906

[58] Field of Search ..... 383/104, 120, 383/121, 105, 107, 116, 119, 122, 210, 211, 906, 200, 202, 203, 204

[56] References Cited

U.S. PATENT DOCUMENTS

| | | | |
|---|---|---|---|
| Re. 27,838 | 12/1973 | Leasure et al. . | |
| 2,298,419 | 10/1942 | Salfisberg . | |
| 2,406,791 | 9/1946 | Belcher | 383/122 X |
| 3,006,257 | 10/1961 | Orsini | 383/120 X |
| 3,084,731 | 4/1963 | Kugler | 383/119 X |
| 3,130,896 | 4/1964 | Mack | 383/119 X |
| 3,277,798 | 10/1966 | Krauss | 383/121 X |
| 3,308,374 | 4/1970 | Bertoglio | 383/122 X |
| 3,434,652 | 3/1969 | Shore | 383/104 |
| 3,613,281 | 10/1971 | Lennartz | 383/119 X |
| 3,663,239 | 5/1972 | Rowe et al. | 383/906 X |
| 3,739,977 | 6/1973 | Shapiro et al. . | |
| 3,810,503 | 5/1974 | Lewis, Jr. et al. | 383/120 X |
| 3,935,993 | 2/1976 | Doyen et al. | 383/104 X |
| 4,454,979 | 6/1984 | Ikeda et al. | 383/104 X |
| 5,195,829 | 3/1993 | Watkins et al. | 383/120 X |
| 5,228,782 | 7/1993 | Imer | 383/906 X |

FOREIGN PATENT DOCUMENTS

| | | | |
|---|---|---|---|
| 0273737 | 1/1965 | Australia | 383/121 |
| 0111750 | 8/1964 | Czechoslovakia | 383/121 |
| 0315724 | 5/1989 | European Pat. Off. | 383/906 |
| 1242107 | 4/1960 | France . | |
| 1342346 | 9/1963 | France | 383/121 |
| 2059363 | 5/1971 | France . | |
| 2193745 | 2/1974 | France | 383/107 |
| 1786047 | 11/1971 | Germany . | |
| 4203798 | 8/1993 | Germany | 383/104 |
| 5-221451 | 8/1993 | Japan | 383/104 |
| 859160 | 1/1961 | United Kingdom . | |
| 1465695 | 2/1977 | United Kingdom | 383/119 |

*Primary Examiner*—Jes F. Pascua
*Attorney, Agent, or Firm*—Sprung Horn Kramer & Woods

[57] ABSTRACT

A bag for liquids, pastes, or granulates. The bag consists of four flexible sheets. The edges of the sheets are fastened together tight along their sides and bottom and to some extent along the top, creating a front wall (1), a rear wall (2), and two side walls (3 & 4), and the four walls demarcate the inside of the bag. The sheets the side walls are made of are thicker and/or more rigid than the sheets the front and rear walls are made of. The bag is designed such that when full it will stand balanced and stable on a level surface.

22 Claims, 11 Drawing Sheets

Figure 1:
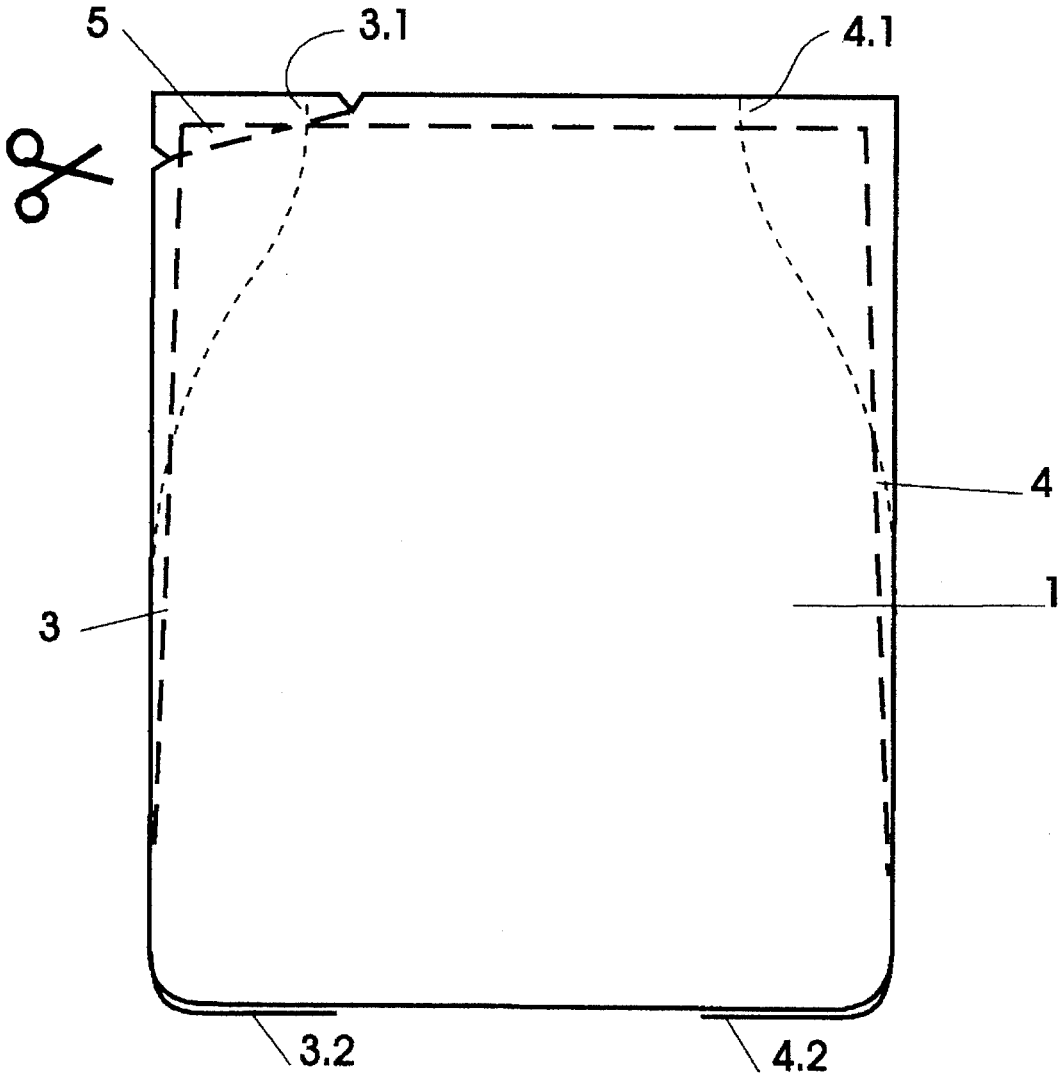

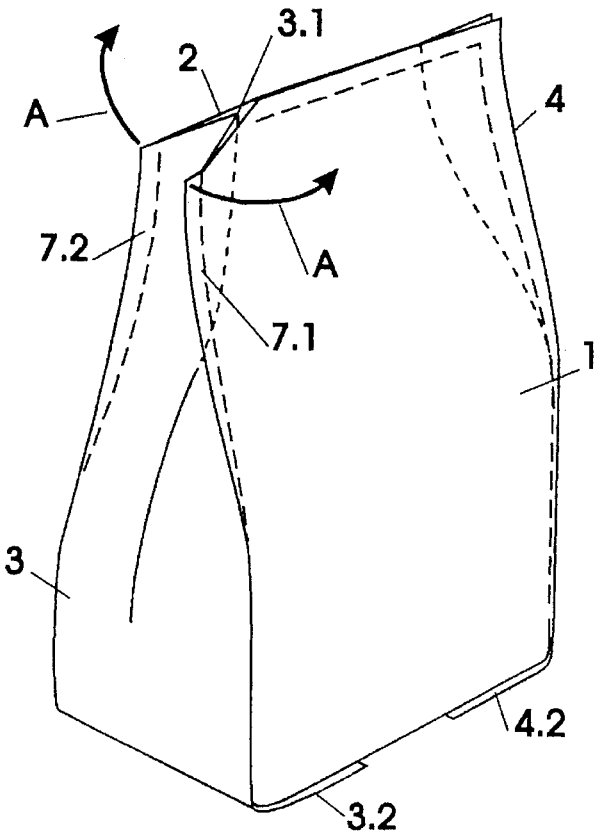
Fig: 5
Fig: 6
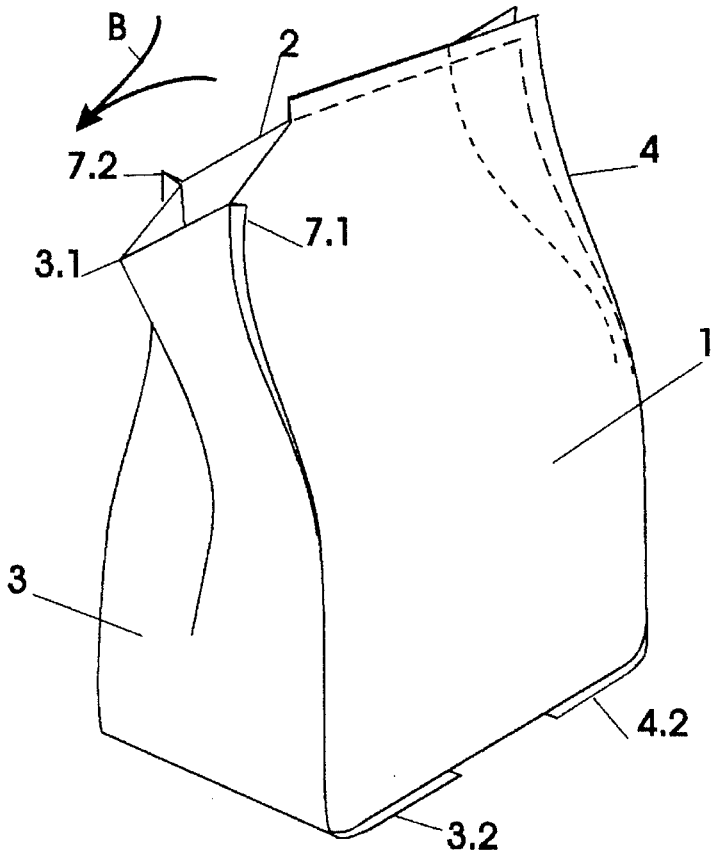

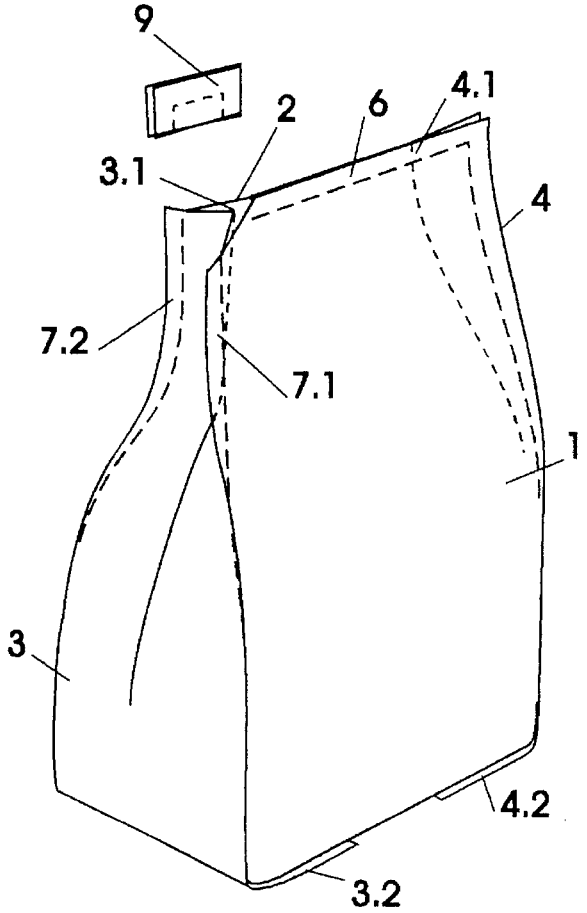
Fig: 8
Fig: 9
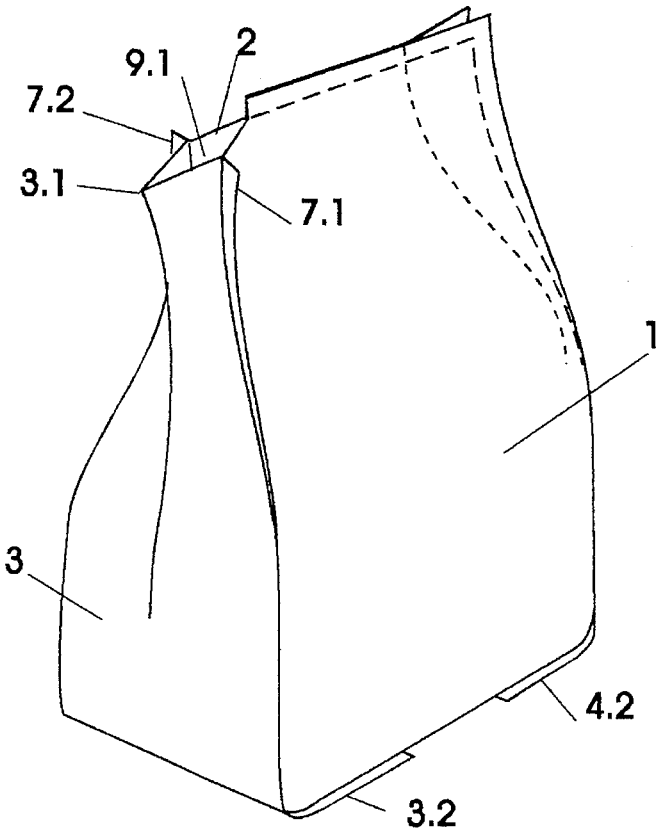

BAG FOR LIQUIDS, PASTES, OR GRANULATES AND METHOD OF MANUFACTURING

This application is a continuation of application Ser. No. 08/070,612, filed Jun. 1, 1993, now abandoned.

The present invention concerns first a bag for liquids, pastes, or granulates. The bag consists of four flexible sheets. The edges of the sheets are fastened together tight along their sides and bottom and to some extent along the top, creating a front wall, a rear wall, and two side walls. The four walls demarcate the inside of the bag.

Many varieties of bags for liquids, pastes, or granulates are known. Some examples are sachets, stand-up bags, tubing bags, paper sacks, and even box-like bags, milk cartons for example. They can be made of coated paper, plastic sheet, metal foil, or plastic-and-foil laminate for example.

It is generally the contents that determine what materials the bags are to be made of. Other factors that help determine the choice of materials are appearance, the desirability of stand-up, how the bags will be shipped, how strong they need to be, whether they will need to be recycled, and cost.

Most known bags are undesirable from at least one of the foregoing aspects. It has in particular been impossible until now to produce a bag from one of these materials that will stand up reliably, at least when full, and look pleasing.

The object of the present invention is accordingly a bag of the aforesaid genus that will stand up stable and balanced on a level surface when full. The bag is also intended to be as simple in structure as possible. It should be attractive. It should have the possibility to provide it with a resealing component that is made only of the same material as the bag. The last is of particular importance because such known means of resealing bags as screw-on caps or snap-caps are expensive and entail recycling problems in that they are usually made of materials other than that of the bag.

Bags that cannot be closed again have on the other hand very limited commercial uses, are not secure, and the life of the contents is limited.

The basic principle of the invention is that the side walls of the bag differ slightly from the front and rear walls in their mechanical properties, specifically in being somewhat more rigid.

As will be specified hereinafter with reference to examples, the result is that the pressure exerted against the walls of a bag in accordance with the invention while it is being filled, will have a different effect on the side walls than it does on the front and rear walls.

The front and rear walls will deform more extensively than the side walls. The bottoms of the side walls will accordingly fold in subject to the weight of the contents and, as the front and rear walls continue to deform, will create such a flat and stable base at the bottom that the sack will stand solid and stable on a level surface.

The difference between the rigidity of the side walls and the front and rear walls can, as recited in the subsidiary claims and with reference to the various examples be attained either by making the side walls out of a different material than the front and rear walls or by making them out of the same material but of a different thickness than the front and rear walls.

How thick the walls will be depends on the size of the bag and on the density of its contents as well for example as on what shape the contents should have.

The walls can be made of single-ply plastic, paper, processed paper, or cardboard. Laminates of various plastics with metal foil, paper, or cardboard can of course also be employed. Unbonded double plies of various materials can also be employed.

It turns out to be of particular advantage for at least the sheets the side walls are made of to be of a laminate, whereby the layer of laminate constituting the outer surface of the finished bag melts and seals at a temperature higher than the layer of laminate constituting the inner surface of the finished bag. This will as specified hereinafter make the bags considerably easier to manufacture. The outer layer of the side wall can be polyester for example and the inner layer polyethylene.

The edges of all four wall sheets in one embodiment of the bag that stands up especially satisfactorily face one another at a right angle at least along the bottom of the bag and are sealed together such that the empty bag will be shaped like a double T when viewed from underneath. This measure ensures that the downward-folded sections of the side walls will constitute an especially ample base.

The bag can on the whole be rectangular when viewed from the front and, due to the tapering together of the upper edges of the front and rear walls, more triangular when viewed from the side.

As will be specified hereinafter with reference to one embodiment by way of example, the bag will be particularly stable if the sheets are hot-sealed or cemented together along their outer edges which point in the same direction. The resulting seams, which can be 3 to 15 mm wide depending on the size of the bag, will make it particularly rigid.

It is on the other hand also possible to produce the bags from a tubular web, whereby one suitable way to ensure that the side walls will be more rigid is to make them narrower.

Many different embodiments of the bag in accordance with the invention are possible if the basic principle is adhered to that the side walls should be more rigid than the front and rear walls.

It is also evident that a contents-removal opening can be introduced very simply at the top of a bag in accordance with the invention by means of a tear-off or cut-off tab. The opening can for example be positioned in the vicinity of one of the corners at the top of the bag so that, once the tab has been torn or trimmed off, a pouring spout can be created by pulling out the top of one of the side walls. To facilitate closing the bag again it is also of advantage for the inside of the bag to have a spout extending toward the upper edge just upstream of the opening and for at least some of that spout to be accommodated in a strip-shaped tab that is delimited from the edge of the bag with the tear-off or cut-off tab at its outer end.

This embodiment of the bag can be closed again by folding down and tucking the tab, which is positioned to be at least partially pulled through a hold-tight slit that extends through the front and rear walls, is sealed off against the inside of the bag, and is as long as the tab is wide and as wide as the tab is thick.

The resulting closure is made of the same material as the bag itself and ensures reliable reclosing. Exploitation of the full potential of the various embodiments of the bag in accordance with the present invention will ensure the following advantages.

1. The bags can easily be manufactured with only slight modifications of existing machinery and methods.
2. They can be made of the materials conventionally employed for such bags.
3. Since they can be made with an almost precisely rectangular footprint, they will take up no more shelf area than absolutely necessary.
4. When full they will stand up unsupported and stable on a level surface.
5. They will be easy to open and can be emptied at a controllable rate no matter what their contents.

6. They will be practical not only for liquids, but also for pastes, powders, granulates, etc.
7. They can be closed again with a simple component of the same material as the bag itself.

Embodiments of the bags and of the method of manufacturing them in accordance with the present invention will now be specified by way of example with reference to the accompanying drawings.

Figure 2:
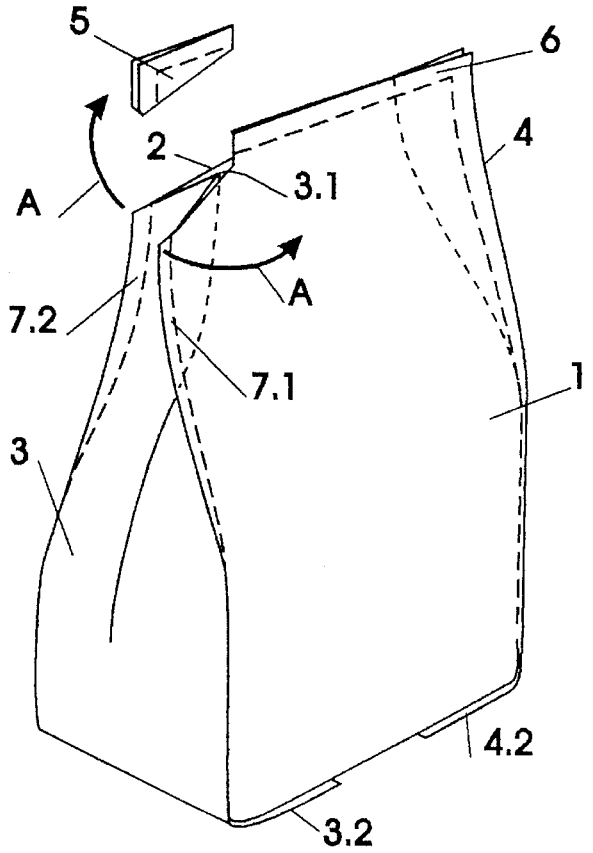
Figure 3:
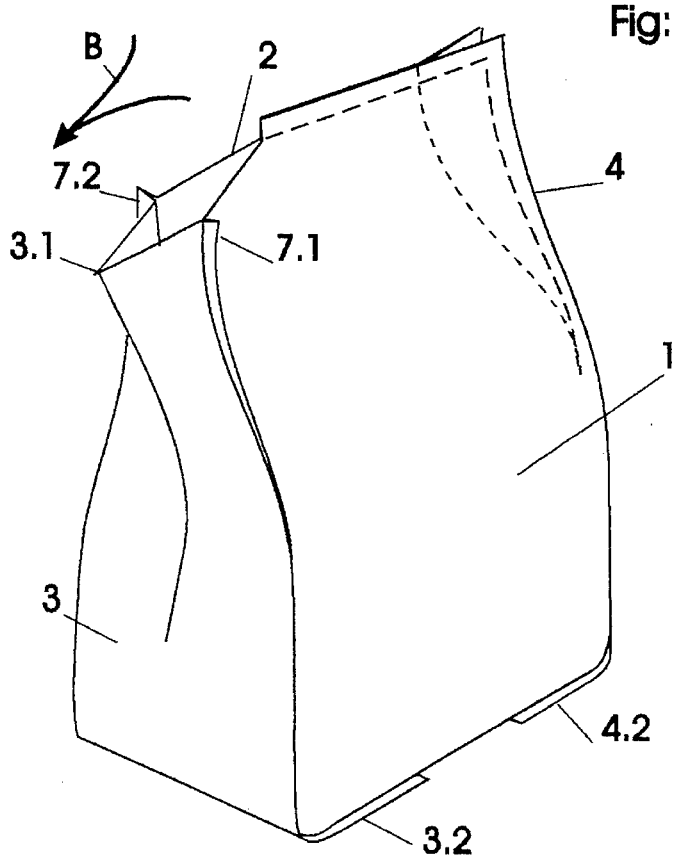
Figure 4:
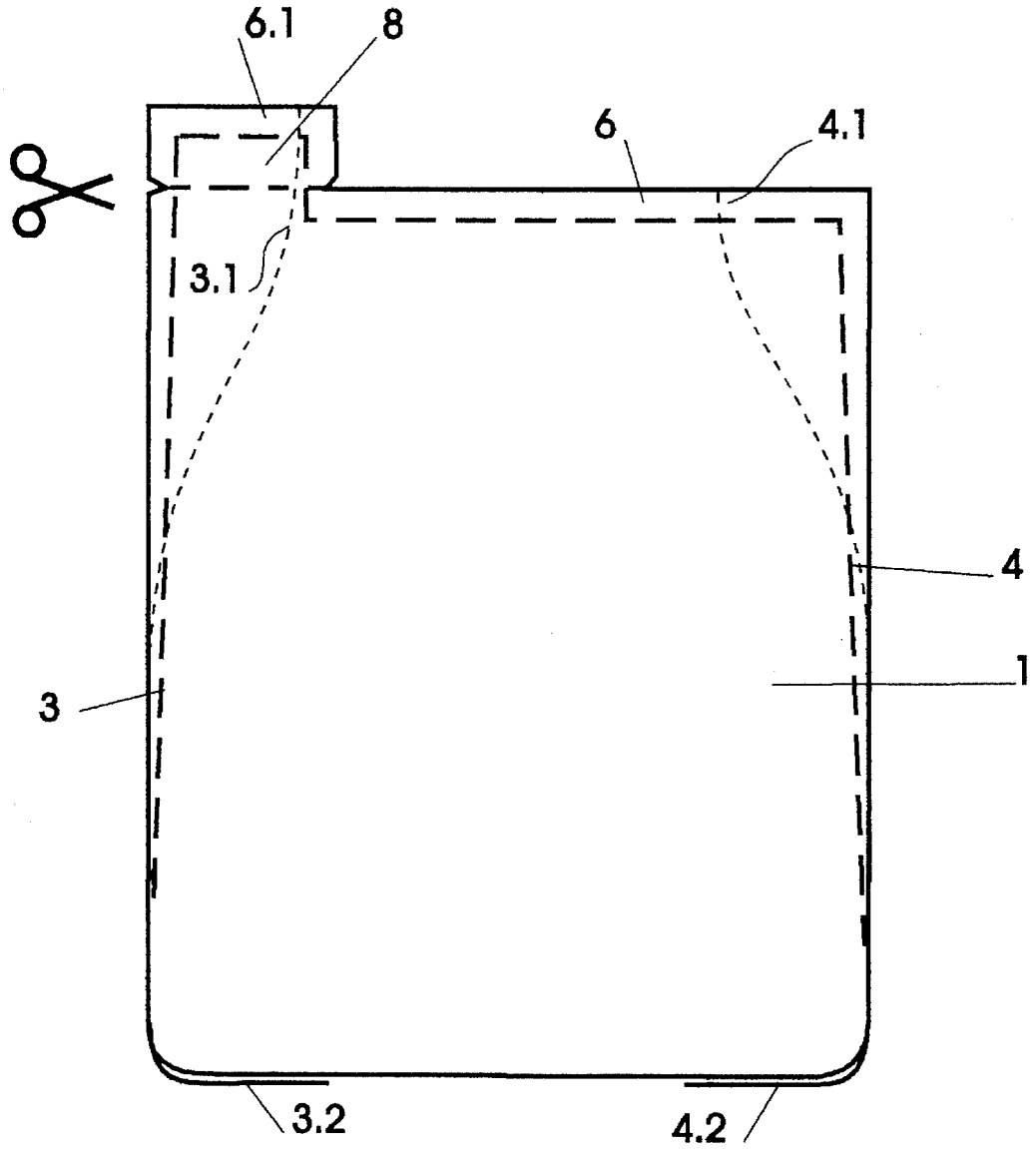
Figure 7:
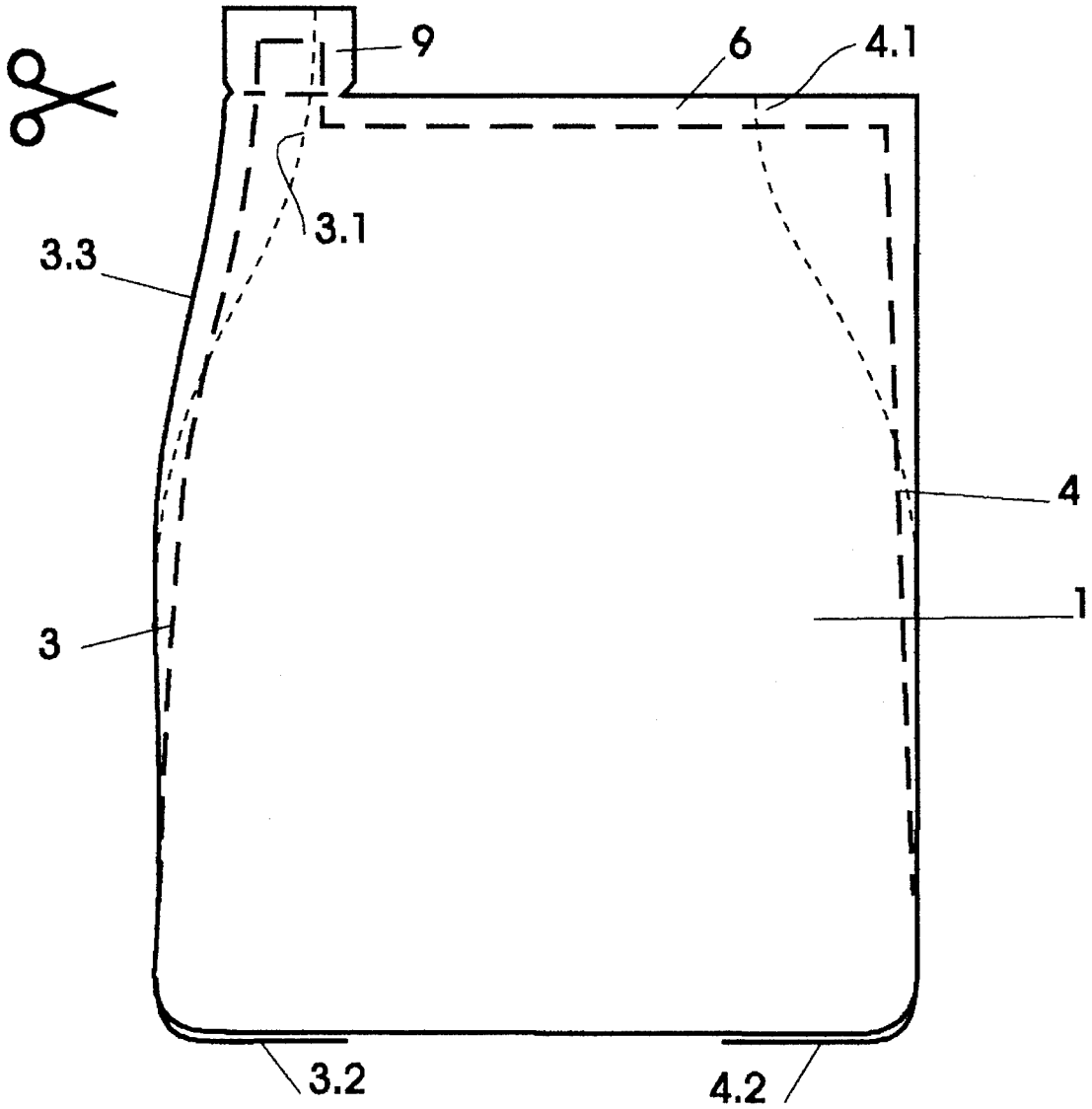
Figure 10:
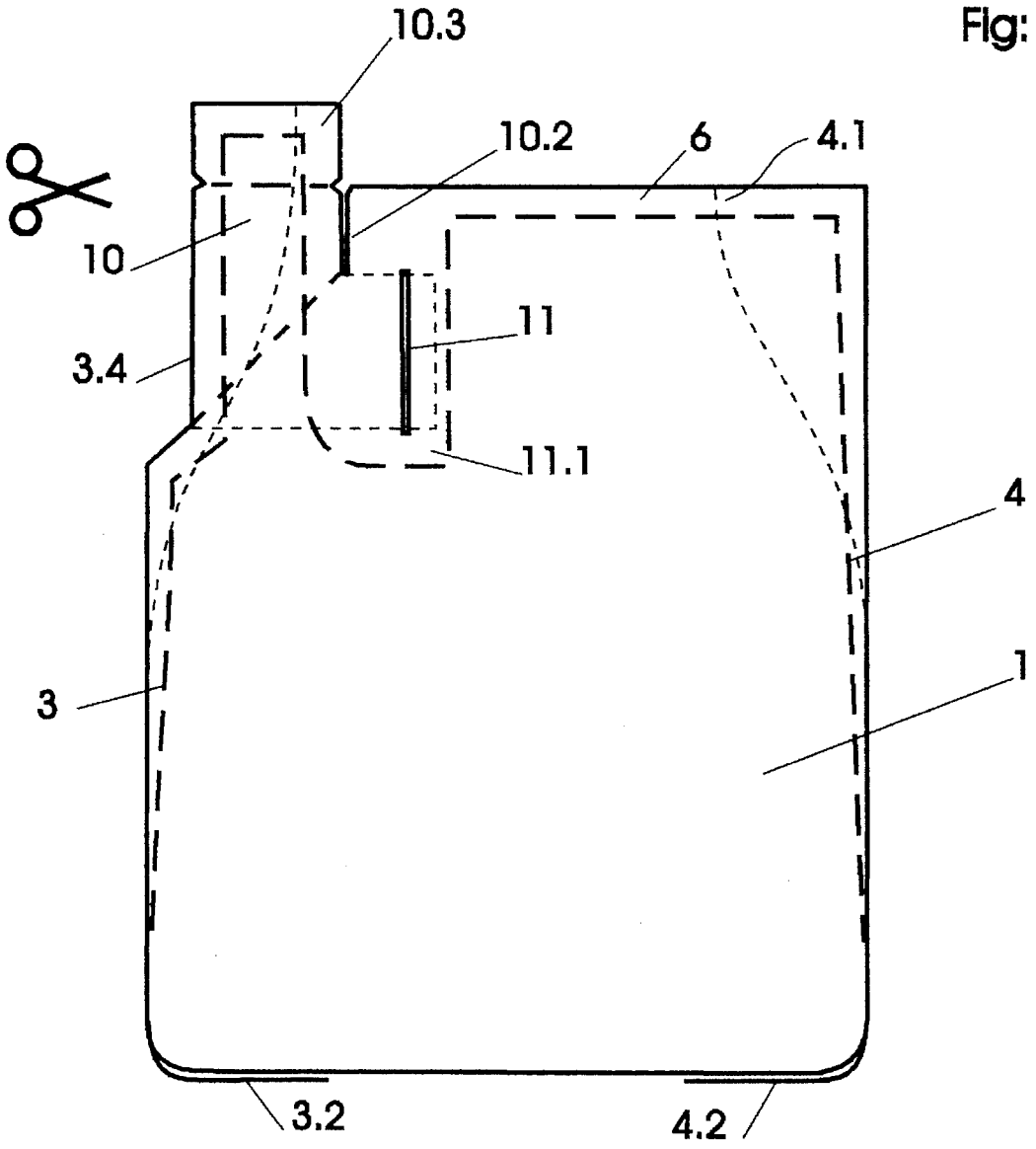
Figure 11:
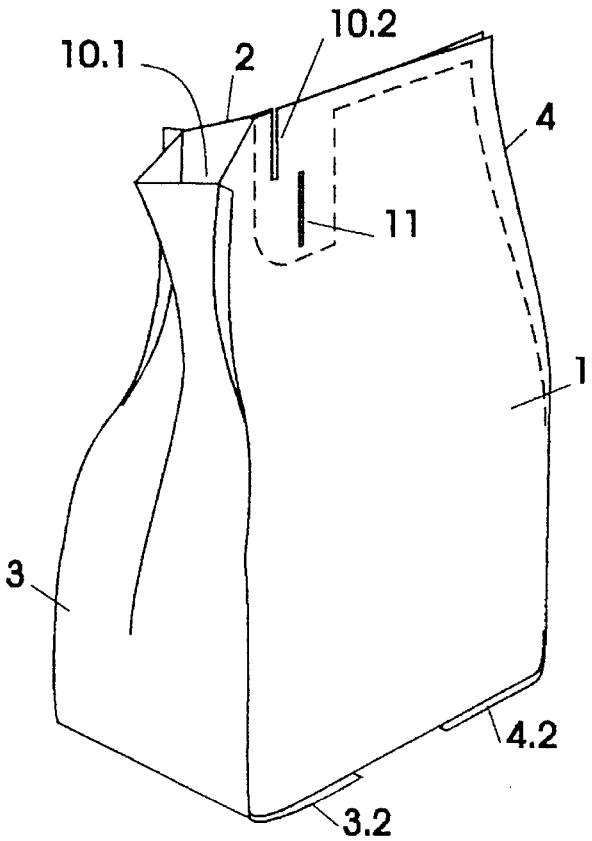
Figure 12:
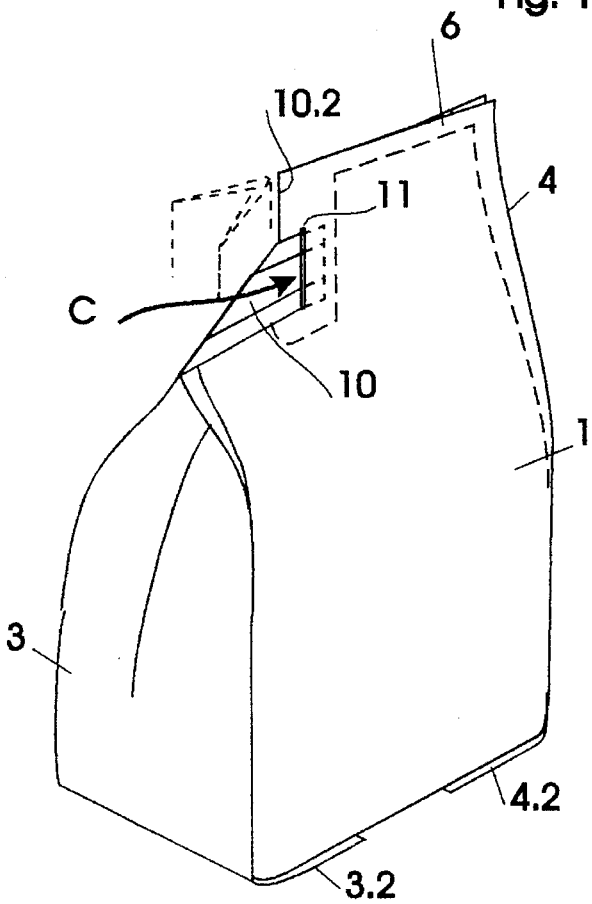
Figure 13:
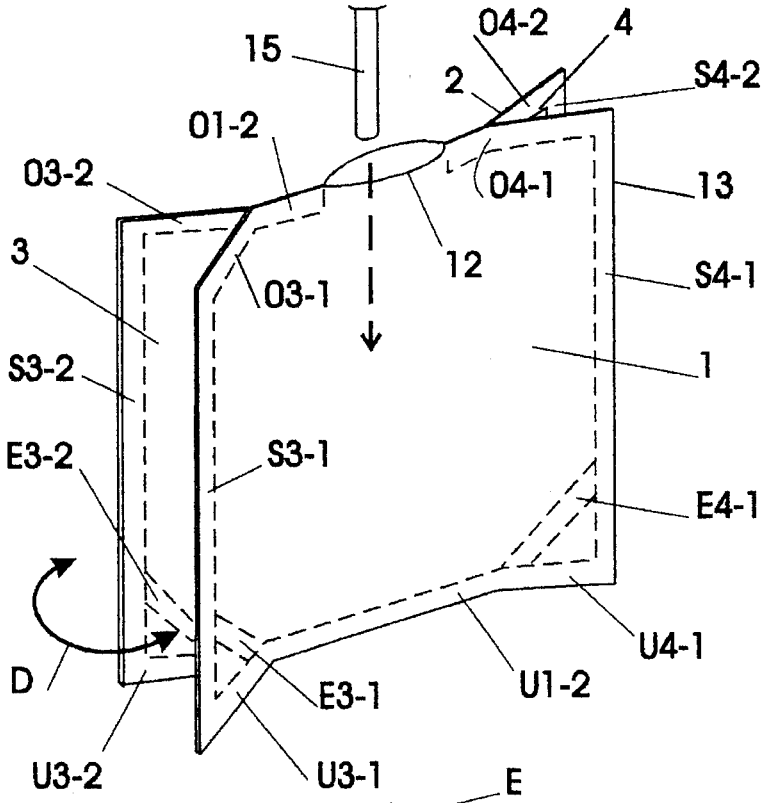
Figure 14:
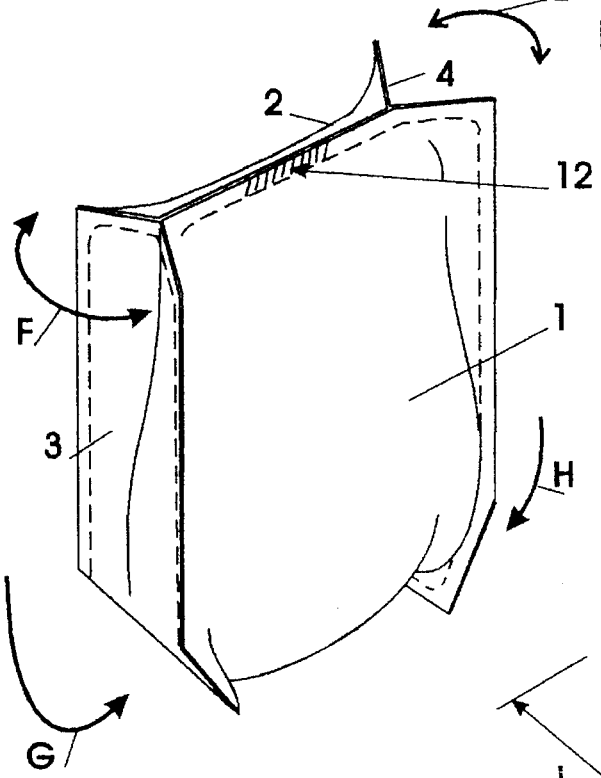
Figure 15:
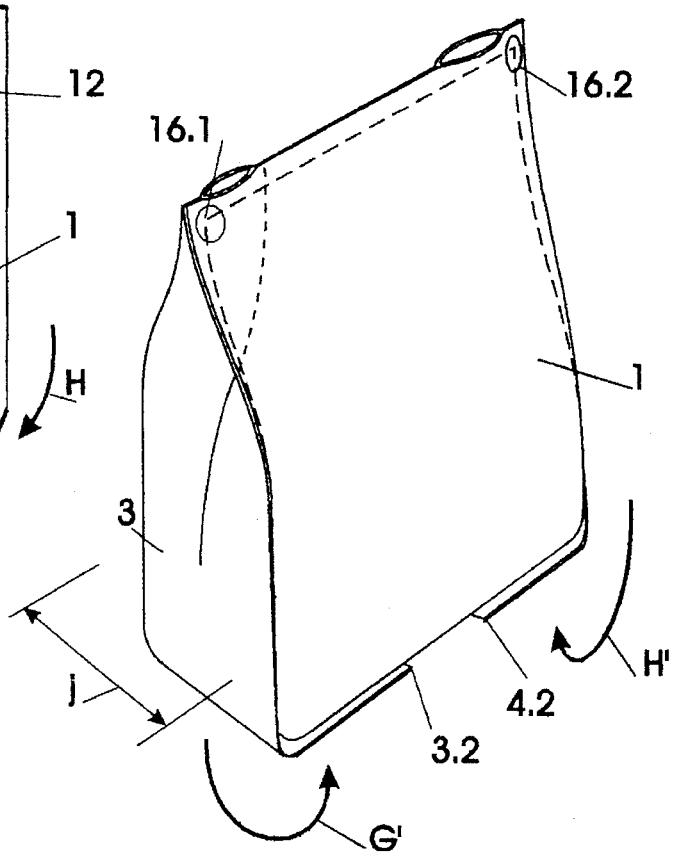
Figure 16:
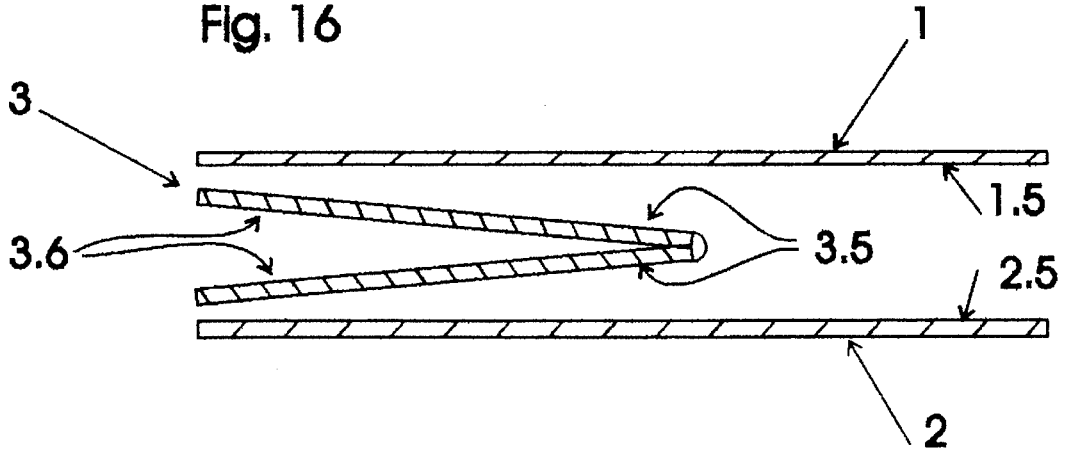
Figure 17:
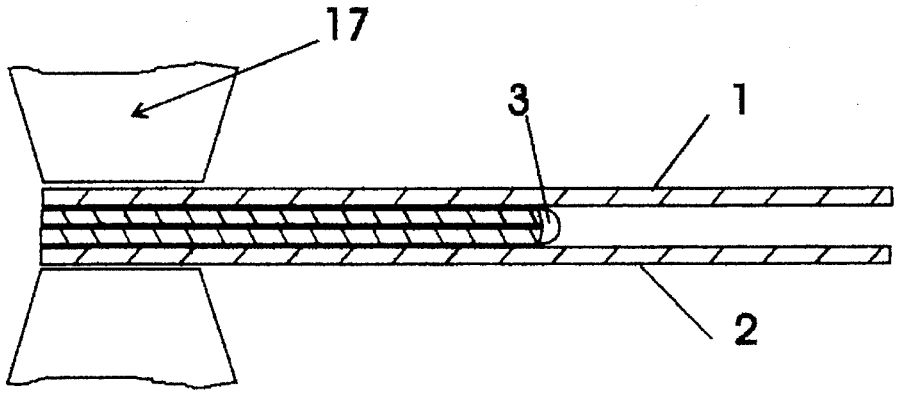
Figure 18:
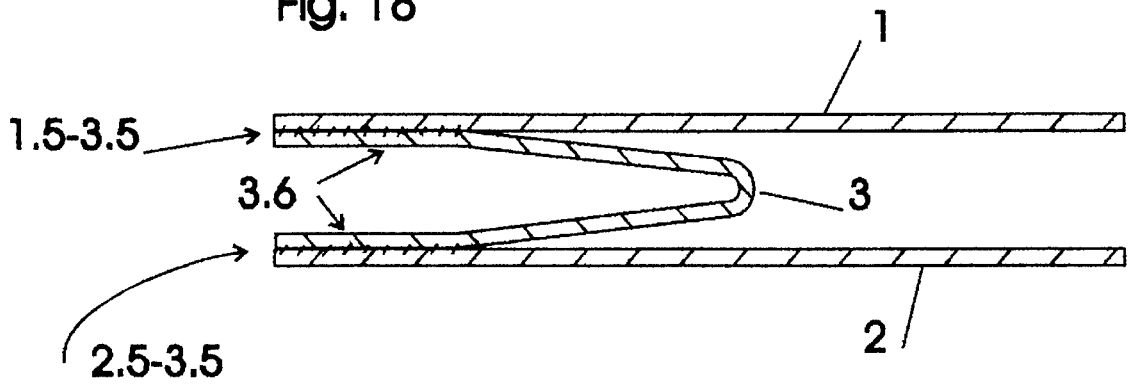
Figures 19, 20, 21, 22:
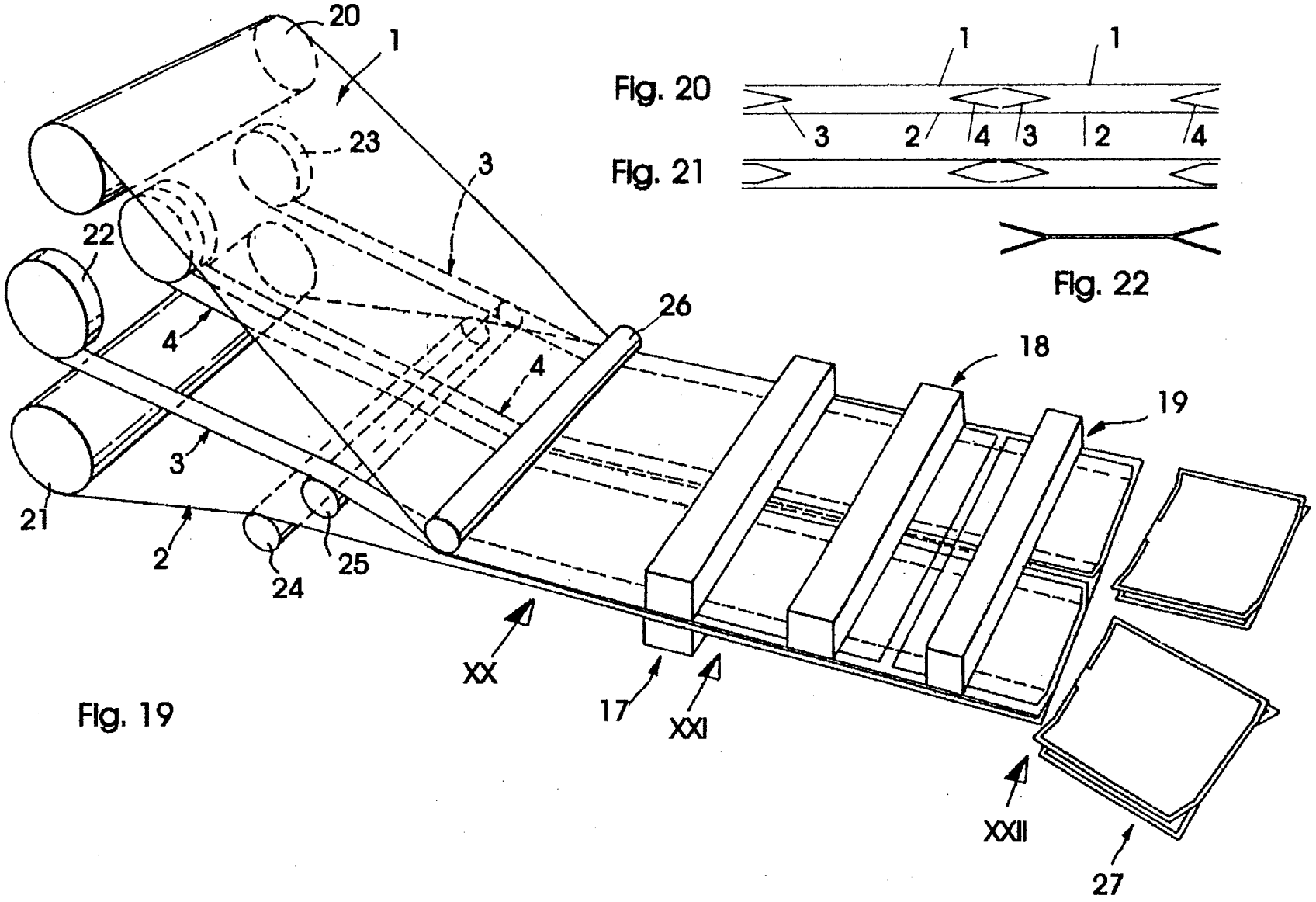

FIG. 1 is a front view of one embodiment of a bag,

FIGS. 2 and 3 are oblique front perspective views of the bag illustrated in FIG. 1 at two different stages of the opening process, FIG. 4 is a front view of another embodiment, FIGS. 5 and 6 are oblique front perspective views of the bag illustrated in FIG. 4 at two different stages of the opening process, FIG. 7 is a front view of still another embodiment, FIGS. 8 and 9 are oblique front perspective views of the bag illustrated in FIG. 7 at two different stages of the opening process, FIG. 10 is a front view of a fourth embodiment, FIGS. 11 and 12 are oblique front perspective views of the bag illustrated in FIG. 10 at two different stages of the opening process, FIGS. 13 through 15 are oblique front perspective views of the bags illustrated in FIGS. 1 through 3 at various stages of being filled, FIGS. 16 through 18 are sections through the material the bags illustrated in FIGS. 1 through 3 are made of at various stages of manufacture, FIG. 19 is a schematic perspective view of machinery for manufacturing the bags illustrated in FIGS. 1 through 3, and FIG. 20 through 22 are sections along the lines XX, XXI, and XXII through the material traveling through the machinery illustrated in FIG. 19.

The various embodiments illustrated in FIGS. 1 through 12 differ only in minor details, and similar parts are numbered the same.

The bag illustrated in FIGS. 1 through 3 has a front wall 1, a rear wall 2, and side walls 3 and 4 in the form of rectangular sheets of plastic or foil. Side walls 3 and 4 are more rigid than front wall 1 or rear wall 2. All sheets can be laminated with an outer layer of polyester and an inner layer of polyethylene. This feature will simplify the manufacturing specified hereinafter with reference to FIGS. 16 through 22. Side walls 3 and 4 can be made more rigid by making them thicker than front wall 1 or rear wall 2.

The front and rear walls in one typical embodiment made of a non-laminate and intended to contain 1 liter of such a non-corrosive household product as liquid cleanser can be made of polyethylene 75 micrometers thick and the side walls of polyethylene 150 micrometers thick.

The front and rear walls in another embodiment made of a laminate and intended to contain 500 ml of skin cream can be made of a polyethylene-aluminum-polyester laminate 75 micrometers thick and the side walls of a laminate of the same structure 125 micrometers thick.

FIGS. 1 through 3 illustrate a full bag. The bottoms 3.2 and 4.2 of side walls 3 and 4 fold under in an inwards direction and constitute a flat base, ensuring that the bag will stand up reliably and stable on a level surface. The tops 3.1 and 4.1 of side walls 3 and 4 on the other hand fold in, providing the bag with an approximately triangular profile when viewed from the side. The front and rear walls of the bag are hot-sealed to the side walls along upper edge 6. The bag can be opened, as will be evident from FIG. 2, by snipping off upper-left corner 5, releasing corners 7.1 and 7.2. Corners 7.1 and 7.2 can then be folded out in the directions indicated by arrows A between side wall 3 and front wall 1 on the one hand and rear wall 2 on the other and the middle upper edge 3.1 of the upper edge pulled out in the direction indicated by arrow B, creating a spout for pouring out the bag's contents as illustrated in FIG. 3. The bag illustrated in FIGS. 1 through 3 is the simplest from the aspects of both structure and manufacture.

FIGS. 4 through 6 illustrate a bag that is similar in principle to the one illustrated in FIGS. 1 through 3, differing only in the structure of the pouring spout.

This bag is not opened by trimming off a corner. It has a tear-off or trim-off tab 8 extending out of the main body of the bag at the top. The upper edge 6.1 of tear-off or trim-off tab 8 is hot-sealed tight and the seal extends to the also hot-sealed upper edge 6 of the bag. Once tab 8 has been torn or trimmed off, the corners 7.1 and 7.2 can be folded out in the directions indicated by arrows A and middle upper edge 3.1 extracted as illustrated in FIGS. 5 and 6 to create the largest pouring spout possible.

The embodiment illustrated in FIGS. 7 through 9 illustrate a bag that is particular appropriate for thinner liquids. It is accordingly provided with a narrow pouring spout, although side walls 3 and 4 are wide as in the embodiment illustrated in FIGS. 4 through 6.

As will be evident from FIG. 7, the bag has a tear-off or trim-off tab 9 at the upper-left corner that extends out beyond the edge. Once tab 9 has been removed, the upper corners 7.1 and 7.2 of side wall 3 are folded out and the middle upper edge 3.1 of the wall can, as will be evident from FIG. 9, be pulled out. The pouring spout is narrow because front and rear walls 1 and 2 narrow slightly at the top 3.3 of left-hand side wall 3. Comparison of FIGS. 7 and 4 will show how this feature will result in a narrower spout.

The embodiments illustrated in FIGS. 1 through 9 cannot be resealed after once being opened.

FIGS. 10 through 12 illustrate an embodiment of the bag that can be resealed again after having been opened. This bag, which is otherwise similar to the embodiment hereinbefore described, has a strip-shaped opening tab 10 with a tear-off section 10.3 that extends beyond the upper edge of the bag. Part of the tab is demarcated at its inner edge from the rest of the bag by a longitudinal slit 10.2 that extends over a prescribed length through front and rear walls 1 and 2. The tightness of the bag is maintained at this point by appropriately sealing the material on each side of slit 10.2. Parallel to slit 10.2 but slightly farther down the bag is a hold-tight slot 11 that also extends through front and rear walls 1 and 2 and is sealed off against the inside of the bag by seals 1.11 that extend around it. Slot 11 is as long as tab 10 is wide and as wide as the tab 10 is thick.

Opening this bag as hereinbefore described by removing tear-off section 10.3 will, as will be evident from FIG. 11, create a pouring spout 10.1 that the bag can be emptied through. If the bag is only partly emptied, pouring spout 10.1 can be pressed back again and tab 10 folded down and tucked through slot 11 as illustrated in FIG. 12. The bag is now closed again and can be opened again by extracting tab 10 from hold-tight slot 11.

This embodiment as well can be slightly narrower at its top 3.4.

How the bag illustrated in FIGS. 1 through 3 changes while being filled into the final shape represented in those figures will now be specified with reference to FIGS. 13 through 15.

The empty bag is, as will be evident from FIG. 13, rectangular. It has a front wall 1 made of one sheet of material, a rear wall 2 made of another sheet, and two side walls 3 and 4, each made of another sheet. All these sheets are rectangular and are hot-sealed together along their edges 13 and 14 such that the inside of the bag is accessible only through an opening 12, through which the mouthpiece 15 of a filling machine can introduced. Just prior to being filled, the bag will be shaped like a double T or a double Y when viewed from below. The lateral edges of side walls 3 and 4 rectangular. It has a front wall 1 made of one sheet of material, a rear wall 2 made of another sheet, and two side walls 3 and 4, each made of another sheet. All these sheets are rectangular and are hot-sealed together along their edges 13 and 14 such that the inside of the bag is accessible only through an opening 12, through which the mouthpiece 15 of a filling machine can introduced. Just prior to being filled, the bag will be shaped like a double T or a double Y when viewed from below. The lateral edges of side walls 3 and 4 will separate in the direction indicated by arrow D as the bag is filled.

The full bag is closed by sealing off opening 12.

As will also be evident from FIG. 13, the sheets are hot-sealed together along the seams at their outer edges which point in the same direction. Side-wall 3 sheet is sealed half-way along its lower edge by seams U3-1, S3-1, and O3-1 and half-way along its upper edge by seams U4-1, S4-1, and O4-1 to front wall 1. Side-wall 4 sheet is sealed half-way along its lower edge by seams U3-2, S3-2, and O3-2 and halfway along its upper edge by seams U4-2 (hidden in FIG. 13), S4-2, and O4-2 to rear-wall 2 sheet. Front and rear walls 1 and 2 are sealed together along the lower edge by a seam U1-2 and along the upper edge by a seam O1-2.

As will be evident from FIG. 14, side walls 3 and 4 tend because of their relative rigidity to fold out laterally in the directions indicated by arrows E and F and front and rear walls 1 and 2 tend because of their relative flexibility to fold under in the directions indicated by arrows G and H until under the weight of the entering contents the bag attains the final shape illustrated in FIG. 15, with the lower sections 3.2 and 4.2 of side walls 3 and 4 completely folded in below the bottom of the bag in the directions indicated by arrows G and H, where they constitute a stable base for the bag to stand up stable and balanced on the level surface represented by arrow j. The points 16.1 and 16.2 at the upper edge of the bag are now sealed together to retain the bag's shape.

How the manufacture of a bag of the type hereinbefore specified can be considerably simplified by using laminates will now be specified with reference to FIGS. 16 through 18. FIG. 16 is a schematic representation of a sheet of material used to create a front wall 1, another sheet used to create a rear wall 2, and a third sheet folded over to create a side wall 3. All the sheets are laminates, and side-wall 3 sheet is thicker as hereinbefore specified than front-wall 1 sheet or rear-wall 2 sheet. The layer 1.5 of front-wall 1 laminate and the layer 2.5 of rear-wall 1 laminate that face the inner surface 3.5 of side-wall 3 sheet are of a plastic with a relatively low hot-sealing temperature, polyethylene for example. The outer surface 3.6 of side-wall 3 sheet on the other hand consists of a material, polyester for instance, with a higher hot-sealing temperature. The edges of wall 1, wall 2, and wall 3 sheets can now be sealed together as illustrated in FIG. 17 with nothing separating the two halves of surface 3.6. The jaws 17 of the sealing apparatus can in fact be applied directly to the edges of the overlapping sheets. As will be evident from FIG. 18, the heat can be applied at a temperature that will leave front-wall 1 sheet sealed to side-wall 3 sheet at points 1.5–3.5, rear-wall 2 sheet sealed to side-wall 3 sheet at points 2.5–3.5, and the outer edges of side-wall 3 sheet separate at points 3.6.

FIGS. 19 through 22 are highly schematic illustrations of machinery for carrying out the method specified with reference to FIGS. 16 through 18. Wall 1, 2, 3, and 4 sheets are extracted from supply rolls 20, 21, 22, and 23 and brought into contact by feed rollers 24, 24, and 26. Wall 3 and 4 sheets are supplied folded in as will be particularly evident from FIG. 20. The sheets are positioned to produce two rows of bags. They travel through hot-sealing jaws 17 that seal the edges. FIG. 21 illustrates the situation downstream of jaws 17. The sheets then travel through a combination of jaws and mechanism 18 that seals off a bottom and slits the sheet lengthwise into two bags. The sheets finally travel through a combination of jaws and mechanism 19 that seals the top of the bags and cuts them off transversely from the web. This situation is illustrated in FIG. 22. The various steps of this process can of course be carried out in other sequences.

The bags leaving the machinery illustrated in FIG. 19 can be stacked and conveyed to filling machinery.

Any known sealing method, hot sealing, ultrasonic sealing, or cementing, can be employed, although hot sealing is preferred for the embodiments herein specified.

It is of course also possible to make the bags out of materials other than laminates. When a single layer of polyethylene is employed, it will be necessary to position a strip of paper or other appropriate material between the facing edges of the sheets that side walls 3 and 4 are made of to prevent them from adhering.

The bags can be filled by known methods. The full bags can be finally molded by hand while being sorted into cartons. It is on the other hand also possible when low-density and light-weight materials are being loaded to final-shape the bag with a blast of compressed air before it is filled.

I claim:

1. A bag comprising: a front wall, a rear wall and two side walls demarcating an inside of the bag receptive of liquids, powders, pastes or granulates and when full having a sealable top portion and a substantially flat rectangular base at a bottom portion thereof upon which the bag stands, wherein the front and rear walls each have bottom edges and the side walls each have a bottom edge having a given length and sealed to the bottom edge of the front wall along half of the given length and sealed to the bottom edge of the rear wall along half of the given length and wherein remaining portions of the bottom edges of the front and rear walls are sealed together, whereby when empty, the two halves of the bottom edge of each side wall along with portions of the bottom edges of the front and rear walls to which the halves are sealed are freely bendable toward and away from each other, such that the side walls are infoldable with the two halves of the bottom edge of each side wall bent toward each other to permit the walls to lie substantially flat and wherein as the bag is filled, the side walls are outfolded with the two halves of the bottom edge of each side wall along with portions of the bottom edges of the front and rear walls to which the halves are sealed, automatically bend away from each other and bottom portions of the side walls automatically fold under the bag and form the base upon which the bag stands.

2. The bag as in claim 1, wherein the side walls comprise material which is less flexible than material of the front and rear walls.

3. The bag as in claim 2, wherein the side walls are made from a different material than the front and rear walls.

4. The bag as in claim 2, wherein the side walls are thicker than the front and rear walls.

5. The bag as in claim 4, wherein the side walls are more than 15% thicker than the front and rear walls.

6. The bag as in claim 1, wherein at least the side walls comprise a laminate having an outer layer forming an outer surface which melts and seals at a temperature higher than an inner layer of the laminate forming an inner surface.

7. The bag as in claim 6, wherein the outer layer is polyester and the inner layer is polyethylene.

8. The bag as in claim 1, wherein the walls are joined by one of a hot-sealed and cemented seam.

9. The bag as in claim 8, wherein the seam is 3 to 15 mm wide.

10. The bag as in claim 1, further comprising seams at the bottom of the bag extending up and out from a midpoint of the lower edge of the side walls to lateral edges at an acute angle joining the side walls with the front wall and the rear wall.

11. The bag as in claim 10, wherein the acute angle is about 45°.

12. The bag as in claim 1, further comprising outer corners of the front wall and rear wall connected together at the top of the full bag.

13. The bag as in claim 1, further comprising a contents-removal opening closed off by a tab at the top of the bag and connected to the bag with a tear-off or trim-off connection.

14. The bag as in claim 13, wherein the opening is in the vicinity of an upper corner of the bag.

15. The bag as in claim 14, wherein the inside of the bag has a spout extending toward an upper edge just upstream of the opening and at least some of that spout is accommodated in a strip-shaped tab that extends beyond the edge of the bag with the tab at its outer end.

16. The bag as in claim 15, further comprising a hold-tight slot as long as the tab is wide and as wide as the tab is thick extending through the front and rear walls and sealed off against the inside of the bag where the tab can be folded down and tucked at least part-way through the slot.

17. The bag as in claim 16, wherein the hold-tight slot parallels the opening tab.

18. The bag as in claim 13, comprising being slightly narrower at the top in the vicinity of the contents-removal opening than at the bottom.

19. The bag as in claim 1, wherein the side walls are narrower than the front and rear walls.

20. The bag as in claim 1, wherein the side walls each have a top edge having the given length, each top edge is sealable to a top edge of the front wall along half the given length and each top edge is sealable to a top edge of the rear wall along half the given length and wherein the top edges of the front and rear walls are sealable together when the bag is filled.

21. The bag as in claim 20, wherein the top edges of the side walls fold in and the top edges of the front wall and rear wall are sealed together all along the top edges.

22. The bag according to claim 1, wherein the front wall and the rear wall are connected to the side walls with seams extending along the length thereof to the bottom edges of the front and rear walls; wherein when empty the seams are parallel to the front and rear walls to permit the walls to lie substantially flat; and wherein as the bag is filled the bottom portions of the side walls folding under the bag include as part of the base, portions of the seams which extend outwardly from the front and rear walls where the front and rear walls meet the base and are normal to vertical faces of the front and rear walls, thereby adding stability to the bag.

* * * * *